US007000694B2

(12) United States Patent
Crews

(10) Patent No.: US 7,000,694 B2
(45) Date of Patent: Feb. 21, 2006

(54) OIL ANCHOR

(76) Inventor: Gregory A. Crews, 9728 N. 700th St., Newton, IL (US) 62448

( * ) Notice: Subject to any disclaimer, the term of this patent is extended or adjusted under 35 U.S.C. 154(b) by 126 days.

(21) Appl. No.: 10/454,105

(22) Filed: Jun. 4, 2003

(65) Prior Publication Data

US 2004/0244987 A1 Dec. 9, 2004

(51) Int. Cl.
*E21B 43/00* (2006.01)
*E21B 43/38* (2006.01)

(52) U.S. Cl. ..... 166/105.5; 166/265; 166/372

(58) Field of Classification Search ..... 166/105.5, 166/265, 372
See application file for complete search history.

(56) References Cited

U.S. PATENT DOCUMENTS

| | | | | |
|---|---|---|---|---|
| 1,578,720 | A * | 3/1926 | Derby | 166/105.5 |
| 2,170,881 | A | 8/1939 | Werts | |
| 3,289,608 | A | 12/1966 | Laval, Jr. | |
| 3,624,822 | A | 11/1971 | Carle et al. | |
| 4,148,735 | A | 4/1979 | Laval, Jr. | |
| 4,149,829 | A | 4/1979 | Pittman et al. | |
| 4,393,927 | A | 7/1983 | Singer | |
| 4,444,251 | A | 4/1984 | Lefebvre et al. | |
| 5,069,286 | A * | 12/1991 | Roensch et al. | 166/312 |
| 5,176,216 | A | 1/1993 | Slater et al. | |
| 5,343,945 | A | 9/1994 | Weingarten et al. | |
| 5,456,837 | A | 10/1995 | Peachey | |
| 5,482,117 | A | 1/1996 | Kolpak et al. | |
| RE35,454 | E | 2/1997 | Cobb | |
| 6,125,936 | A | 10/2000 | Swisher | |
| 6,131,655 | A | 10/2000 | Shaw | |
| 6,155,345 | A | 12/2000 | Lee et al. | |
| 6,179,054 | B1 | 1/2001 | Stewart | |
| 6,196,312 | B1 | 3/2001 | Collins et al. | |
| 6,237,691 | B1 | 5/2001 | Kelley et al. | |
| 6,283,204 | B1 | 9/2001 | Brady et al. | |
| 6,325,152 | B1 | 12/2001 | Kelley et al. | |
| 6,336,503 | B1 | 1/2002 | Alhanati et al. | |
| 2001/0004017 | A1 | 6/2001 | Lopes | |
| 2001/0007283 | A1 | 7/2001 | Johal et al. | |
| 2001/0017207 | A1 | 8/2001 | Haheim | |

* cited by examiner

*Primary Examiner*—David Bagnell
*Assistant Examiner*—Giovanna Collins
(74) *Attorney, Agent, or Firm*—Polsinelli Shalton Welte Suelthaus PC

(57) ABSTRACT

This invention relates to apparatus and methods used in the production of petroleum. The apparatus and methods maintain an amount of oil on oil well casing perforations for improved petroleum production. The apparatus for the production of petroleum includes: a pump intake tube having an opening, an oil anchor generally encircling the pump intake tube, the oil anchor having an open base and vent holes in the oil anchor above the opening of the pump intake tube, a casing generally encircling the oil anchor, and perforations in the casing that are below the opening of the pump intake tube and are above the open base of the oil anchor. The method of petroleum production includes providing a pump intake tube having an opening, providing an oil anchor generally encircling the pump intake tube, the oil anchor having an open base and locating vent holes in the oil anchor above the opening of the pump intake tube, providing a casing generally encircling the oil anchor, and locating perforations in the casing below the opening of the pump intake tube and above the open base of the oil anchor, and pumping a produced fluid comprising petroleum.

22 Claims, 8 Drawing Sheets

OIL ANCHOR

FIELD OF THE INVENTION

This invention relates to apparatus and methods used in the production of petroleum. The apparatus and methods maintain an amount of oil on oil well casing perforations for improved petroleum production.

BACKGROUND OF THE INVENTION

Most petroleum well pumping systems utilize some form of gas and sediment separator. The most common separator is referred to as a mud anchor or a conventional "poor boy" separator such as shown in FIGS. 1 and 2. The performance of this simple design is adequate for most low volume wells.

More complex related art varies from static designs with multiple chambers (U.S. Pat. No. 6,336,503), baffles (U.S. Pat. No. 6,179,054) or spiraling cascades (U.S. Patent Application No. 2001/0004017), to dynamic designs with rotating turbines (U.S. Pat. No. 6,283,204 and U.S. Pat. No. 6,155,345). The more complex art is designed primarily to address gas problems in high volume wells. Whereas the present invention is designed to submerse casing perforations in fluid enriched with produced oil, if the prior art is configured such that the casing perforations are submersed, then annular fluid will be enriched with produced water.

Prior art oil production apparatus designed to control the coning of formation water near the wellbore and to separate oil and water downhole utilize configurations where the oil and water zones are both perforated, with the oil zone being perforated at the top of the reservoir formation and the water zone being perforated at the base of the reservoir, and with an unperforated interval between the two sets of perforations. The oil is pumped from above the upper perforations, while the water is pumped from below the lower perforations, either with an open wellbore (U.S. Pat. No. 6,196,312) or with an isolation packer set between oil perforations and water perforations (U.S. Pat. No. 6,131,655 and U.S. Pat. No. 6,125,936). Whereas the present invention provides the following functions, none of the prior art provide submersion of the entire perforated interval in oil or provide the option of slowing the fluid production rate with the hydraulic head of a predetermined oil column, none of the prior art described in Section [0004] include components for gas and sediment separation.

SUMMARY OF THE INVENTION

The present invention provides an apparatus and method for maintaining a column of oil in an annulus between a production string and an oil well casing, while separating gas and sediment from a produced fluid. The column of oil is maintained on perforations in the oil well casing. The column of oil in the annulus is also adjacent to the oil producing rock formation. As gravity separation is the physical mechanism, a watercut will be present in the oil column in the annulus and the watercut will increase with increasing fluid production. Thus, the efficiency of this apparatus will increase as fluid production rates decrease. Lower production rates may be achieved by raising the level of the oil column in the annulus to reduce the amount of water proportionally produced by an oil well.

The method requires setting the production string such that an opening of a pump intake tube is above the perforations in the oil well casing. The specific depth setting is determined by the preferred hydraulic head at the oil producing rock formation.

The apparatus includes an open-ended string of production tubing attached to a pump seating nipple and perforated immediately below the seating nipple (above the pump intake level) and extending below the producing formation and the perforations in the oil well casing. Commonly referred to as a mud anchor or conventional "poor boy" separator when the apparatus is close-ended, the open-ended embodiment, as herein configured and described, will be referred to as an oil anchor.

The present invention provides for the down-hole separation of gas and sediment from a produced fluid. The present invention provides an annular oil column adjacent to the producing formation for the purpose of: 1) minimizing casing perforation scale, mineral or paraffin buildup and the need for chemical treatment to control the above, 2) optimizing chemical treatments that are dripped down the casing annulus by prolonging and intensifying the treatment as the chemical is drawn past the perforations to the base of the oil anchor, rather than being drawn into a conventional separator at the surface of the annular fluid, 3) minimizing water coning in the producing rock formation, 4) slowing fluid production with a head of oil, and 5) increasing oil production and reducing water production.

The present invention utilizes gravity separation as the physical mechanism to separate gas and sediment from the fluid. Gas separation occurs when gas bubbles upward as the fluid moves down the annulus and sediment separation occurs by particles dropping out as the fluid turns and moves up through the oil anchor. Since formation gas expands as it undergoes a pressure drop at the wellbore, the oil anchor may be extended deeper if additional time is required for gas bubbles to expand and coalesce.

As many oil producing wells with low production rates and high watercuts require excessive chemical treatments, cleanouts and re-perfs to reduce plugging or sealing of the casing perforations, the present invention will significantly reduce maintenance costs for these wells. Often fluid levels are maintained above the casing perforations to reduce the oxidizing effects of exposure on the reservoir rock and casing perforations; however, due to gravity separation of the produced fluid, the uptake of fluid from above the casing perforations removes an oil fraction first. This results in submersion of the casing perforations in salt water. Embodiments of the present invention draw the fluid down from the perforations, removing a water fraction first, while the fluid level is maintained above the casing perforations. The resulting submersion of the casing perforations in oil will reduce the oxidizing effects often caused by submersion in salt water or exposure to air. In wells where scale, mineral precipitation, paraffin, etc. are still a problem, chemical treatments (with specific gravities comparable to oil) administered as drips down the casing annulus will be better retained in the annular oil column, thus prolonging the chemical's influence. With a common mud anchor, much of the chemical treatment is pumped off above the perforations resulting in waste of the chemical treatment.

Since some degree of oil and water stratification is present in nearly all reservoir formations, this invention is intended to increase the migration rate of the oil, while slowing the migration rate of water and hence minimize the water coning effect near the wellbore. When oil moves through the pore space of an oil-wet rock, the effect of surface tension is minimal as the migrating oil is continuous with the oil already in contact with the rock surface. When oil moves through the pores of a water-wet rock, the effect of surface tension is maximized as the oil must "bead up" to pass through the water already in contact with the rock surface;

in effect, pore size and permeability with respect to oil are reduced. When water moves through the pore space of a water-wet rock, the effect of surface tension is minimal as the migrating water is continuous with the water already in contact with the rock surface. When water moves through the pores of an oil-wet rock, the effect of surface tension is maximized as the water must "bead up" to pass through the oil already in contact with the rock surface; in effect, pore size and permeability with respect to water are reduced. As water migrates faster than oil in either event, the above-described property may be utilized to slow water invasion, but not to stop it. Since this invention maintains an oil column in the wellbore adjacent to the formation, the oil-wet formation will be more resistant to water invasion. In wells which produce a water fraction, a common mud anchor maintains a water column in the wellbore adjacent to the formation and the oil-wet rock near the wellbore will rapidly become water-wet due to water coning from below and lateral invasion from the wellbore. In wells which produce interstitial water, the gravity separation of wellbore water into the formation can open a channel to deeper water, thus initiating premature coning. In wells with a distinct oil/water contact below the casing perforations, the oil anchor can be extended up the wellbore, setting the pump intake and thus the fluid level in the casing annulus, such that the hydraulic head of the annular oil column will slow the production rate to the oil migration rate.

An alternate embodiment relates to downhole oil/water separation and dual tubing production of an oil fraction and a water fraction with a minimal oil cut.

BRIEF DESCRIPTION OF THE DRAWINGS

FIG. 10(*a*) shows original formation conditions, while FIG. 10(*b*) shows the water coning effect after production.

DETAILED DESCRIPTION OF PREFERRED EMBODIMENTS

Figure 1:
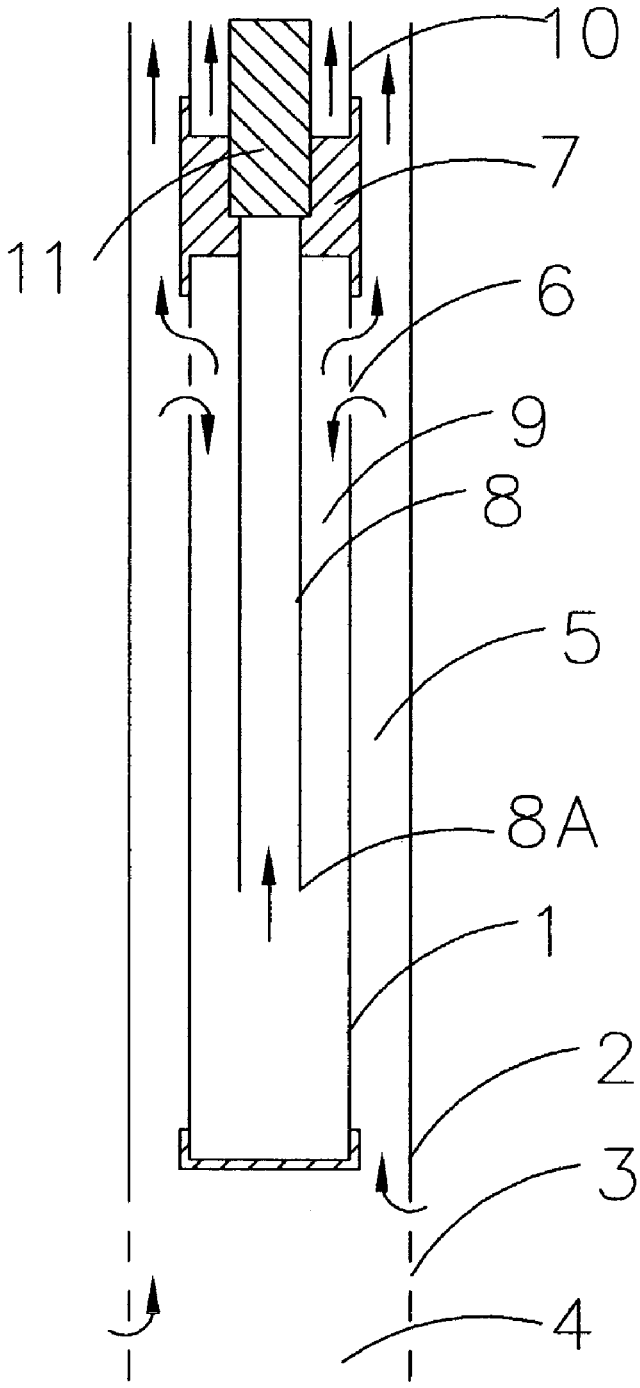
FIG. 1 PRIOR ART
FIG. 1 is a sectional side view of an oil well with casing and tubing and illustrates a common mud anchor or conventional "poor boy" separator.
Figure 2:
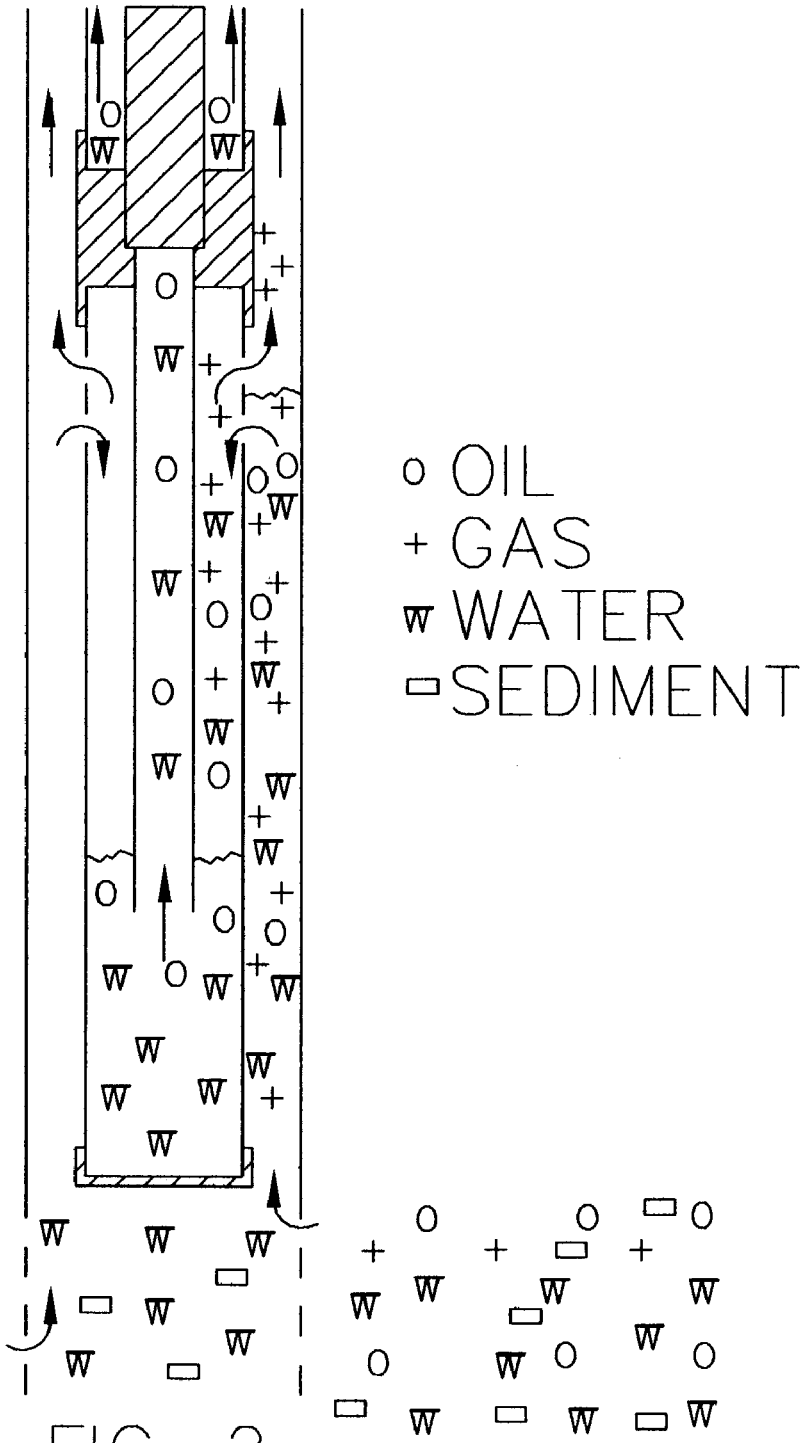
FIG. 2 PRIOR ART
FIG. 2 is an illustration of the production of the produced material by the mud anchor of FIG. 1.

FIG. 1 illustrates a common mud anchor 1 or a conventional "poor boy" separator 1 according to the prior art. The mud anchor 1 is set above casing perforations 3 in a casing 2. Produced material (including sediment, gas, and fluid) from the formation enters a wellbore 4 via the casing perforations 3. Produced fluid may comprise oil, water, other fluids, and mixtures thereof. FIG. 2 illustrates the flow and transfer of produced material in the mud anchor 1. Sediments fall out in the wellbore 4 as the produced gas and the produced fluid ascend a casing annulus 5 between the mud anchor 1 and the casing 2. Produced fluid enters the mud anchor 1 via holes 6 just below a pump seating nipple 7. Produced gas bubbles off as the produced fluid enters the mud anchor 1 and the produced fluid descends an anchor annulus 9 between a pump intake tube 8 and the mud anchor 1. The produced gas may also ascend to the surface via the mud anchor holes 6 and the casing annulus 5. Produced fluid is drawn up through a pump intake tube opening 8*a* and the pump intake tube 8 by a pump 11 and pushed to the surface via a production tubing 10. It is important to note that the level of the produced fluid in the casing annulus 5 will be maintained at the mud anchor holes 6 and gravity separation will cause the oil to enter the mud anchor 1 first, thus leaving the produced fluid in the casing annulus 5 and wellbore 4 enriched with water and resulting in the aforementioned disadvantages.

Figure 3:
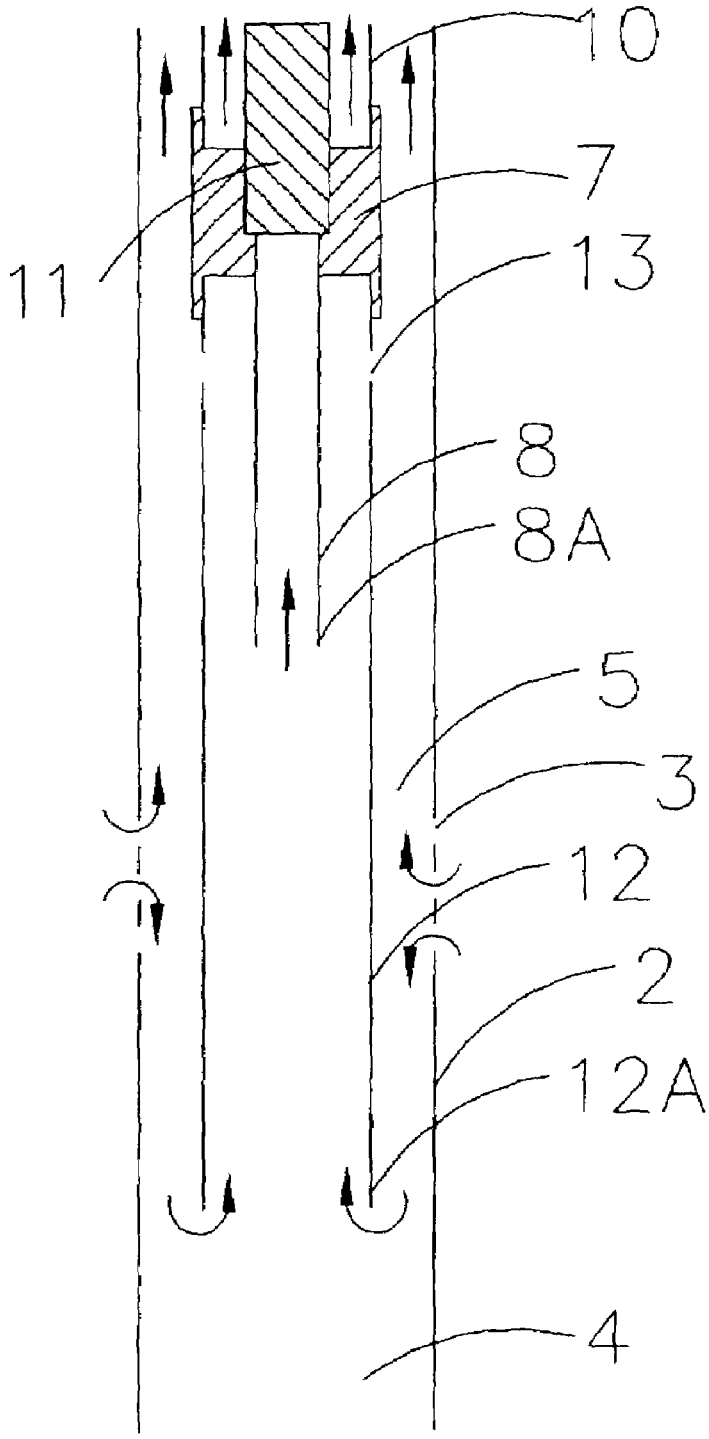
FIG. 3 is a sectional side view of an oil well with casing and tubing and illustrates a first embodiment of the invention.

FIG. 3 illustrates a first embodiment of the present invention. An oil anchor 12 is set with the pump intake tube opening 8*a* above the casing perforations 3, and an opened base 12*a* of the oil anchor 12 is below the casing perforations 3. Vent holes 13 are located in the oil anchor 12 just below the pump seating nipple 7. The oil anchor 12 generally encircles the pump intake tube 8 and forms the anchor annulus 9 therebetween. The casing 2 generally encircles the oil anchor 12 and forms the casing annulus 5 therebetween.

Figure 4:
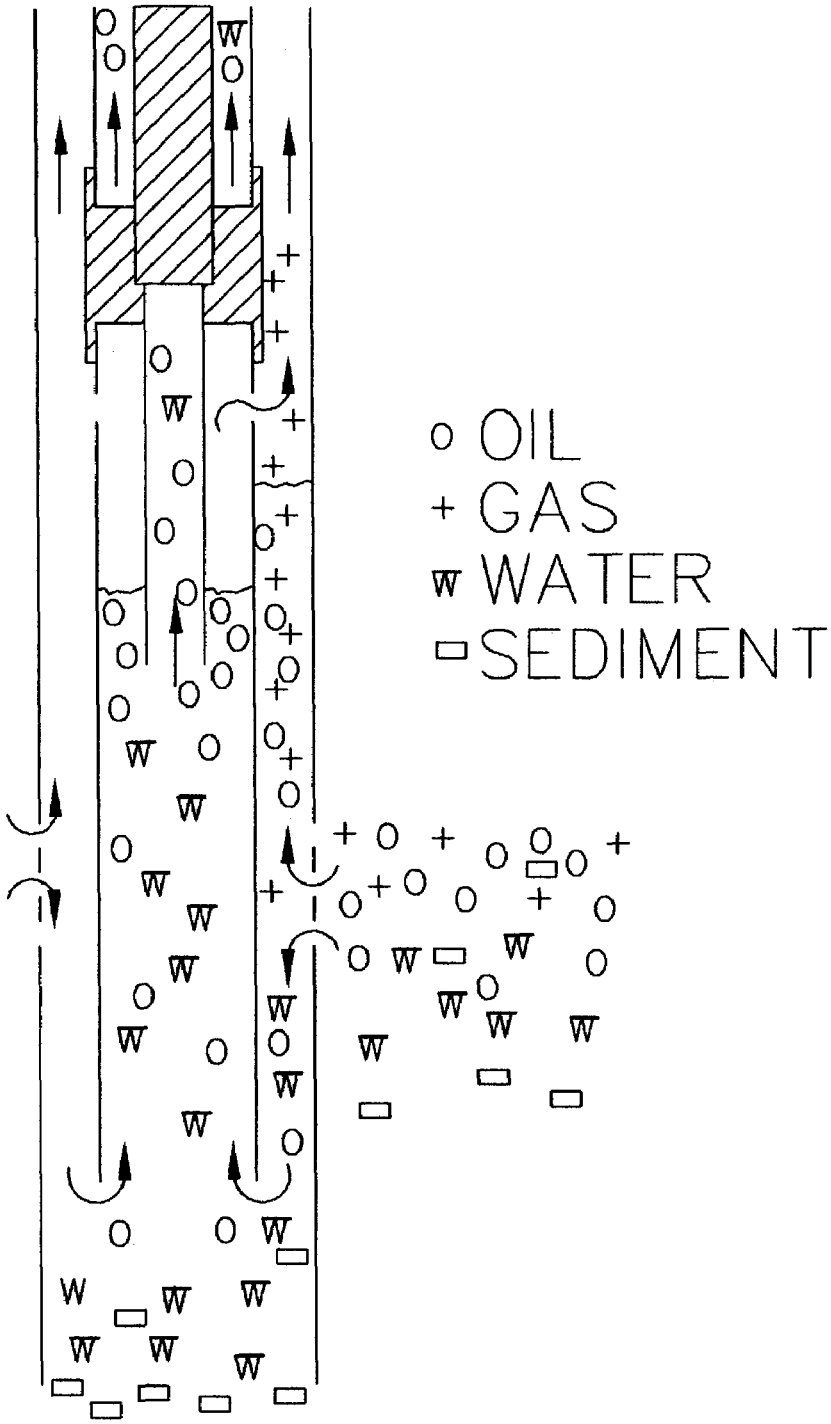
FIG. 4 is an illustration of the production of produced material by the apparatus of the present invention of FIG. 3.

The spatial relationship between the vertical locations of the casing perforations 3, the opened base 12*a* of the oil anchor 12, and the pump intake tube opening 8*a* is critical to the present invention. As shown in FIG. 4, produced fluid enters the casing annulus 5 via the casing perforations 3. Water and sediment move down the casing annulus 5 while gravity separation leads to the accumulation of an oil column and gas in the casing annulus 5 above and adjacent to the casing perforations 3. The pressure drop caused as produced fluid enters the casing 2 leads to gas expansion and subsequent bubble coalescence as the produced gas moves up through the oil column in the casing annulus 5. The gas bubbles off and ascends to the surface via the casing annulus 5. Sediments fall out in the wellbore 4 as produced fluid ascends inside the oil anchor 12. Produced fluid is drawn up the pump intake tube 8 by the pump 11 and pushed to the surface via the production tubing 10.

It is important to note that the level of produced fluid in the oil anchor 12 will be maintained at the level of the pump intake tube opening 8*a* and gravity separation will cause the oil to be drawn off first, leaving the produced fluid in the oil anchor 12 enriched with water. The higher specific gravity of the water in the oil anchor 12 will push the fluid level of the oil column in the casing annulus 5 slightly higher than the fluid level inside the oil anchor 12.

The difference in the depths of the pump intake tube opening 8*a* and the oil anchor vent holes 13 should be engineered to allow for the difference in specific gravities of the produced oil and water as well as to allow for fluid fill up during the dead time of the down stroke if a conventional reciprocating rod pumping system is utilized, i.e., the oil column in the casing annulus 5 should not be allowed to spill through the vent holes 13 into the oil anchor 12 or chemical treatments administered down the casing annulus 5 will be drawn off before reaching the casing perforations 3.

In wells where chemical treatments are not utilized, an oxidation "skin" may develop on the uncirculated surface of the oil column in the casing annulus 5, thus blocking gas flow to the surface and eventually bonding the oil anchor 12 to the casing 2 with a "tar donut." In this case, the oil anchor 12 could be engineered to allow a small portion of the oil produced by the formation during the dead time of the down stroke to spill into the oil anchor 12 via the vent holes 13. Alternatively, a surface pump jack could be shut down periodically to allow fluid fill up above the vent holes 13 and subsequent production via the vent holes 13. If an alternate pumping system is utilized (such as electric submersible), the necessary dead time could be controlled from the surface and programmed as required.

Figure 5:
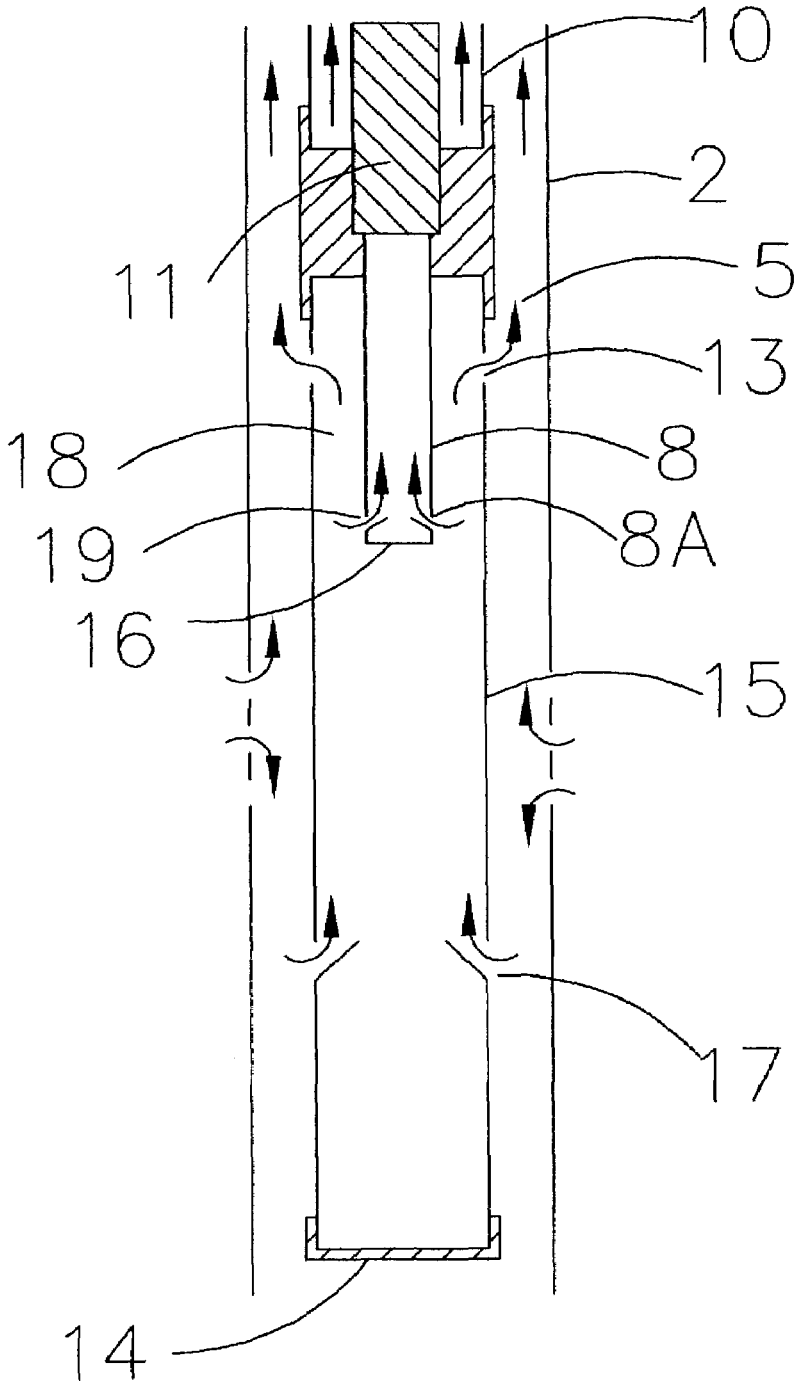
FIG. 5 is a sectional side view of an oil well complete with casing and tubing and illustrates a second embodiment of the invention having a shielded intake tube, as well as a shielded anchor, for protection against plug off in bottom sediment.

FIG. 5 illustrates a second embodiment of the present invention. The design and function is the same as the first embodiment with the addition of a protective cap 14 on the base of an oil anchor 15 and a gas shield 16 on the base of the pump intake tube 8. In this embodiment of the present invention, fluid enters the oil anchor 15 via intake holes 17 set at the same depth as the base of the oil anchor 12 in the first embodiment. The protective cap 14 prevents plug off if the oil anchor 15 is inadvertently lowered into bottom sediment when the production string is run into the well. The protective cap 14 may be replaced by and/or include, for example, an oil anchor base that is crimped, welded, sealed or otherwise closed. In wells where too much gas is still reaching the pump 11, a gas shield 16 may be utilized to block the direct uptake of gas, wherefore it may bubble off into an annulus 18 between the pump intake tube 8 and the oil anchor 15 as oil and water are drawn up the pump intake tube 8 via intake holes 19. This gas ascends to the surface via the oil anchor vents 13 and the casing annulus 5.

Figure 6:
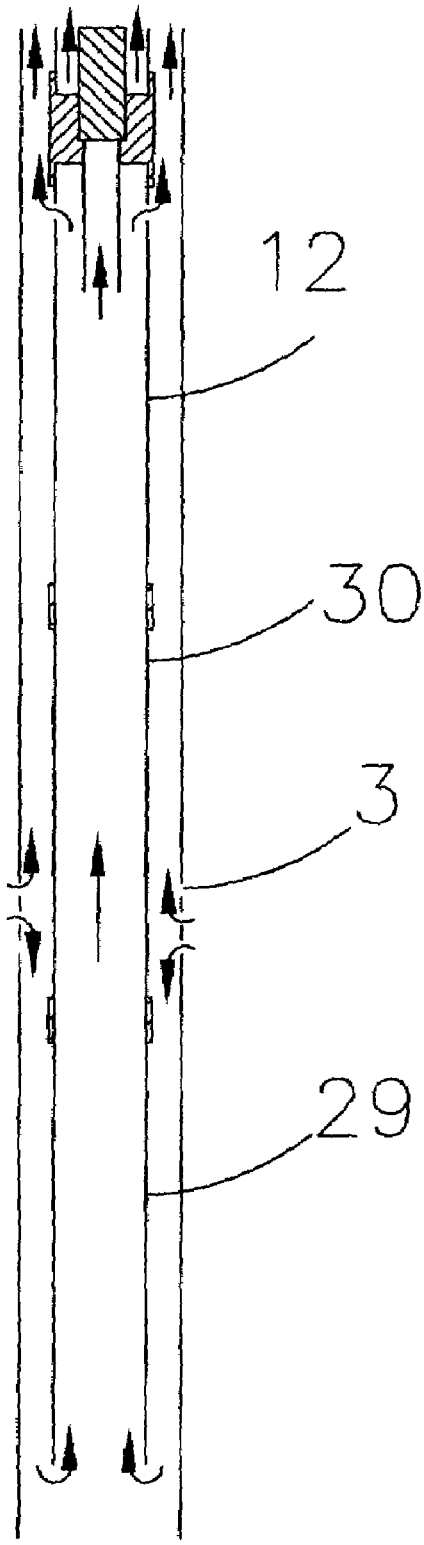
FIG. 6 is a sectional side view of an oil well complete with casing and tubing and illustrates a third embodiment of the invention having additional tubing to extend the oil anchor farther above and below the casing perforations.

FIG. 6 illustrates a third embodiment of the present invention. The design and function is the same as the first embodiment. FIG. 6 illustrates an extension of the basic oil anchor 12 above and below the casing perforations 3 using additional tubing. The extension 29 below the perforations 3 will provide additional separation time. The extension 30 above the perforations 3 will provide a head of oil to slow the production rate.

Figure 7:
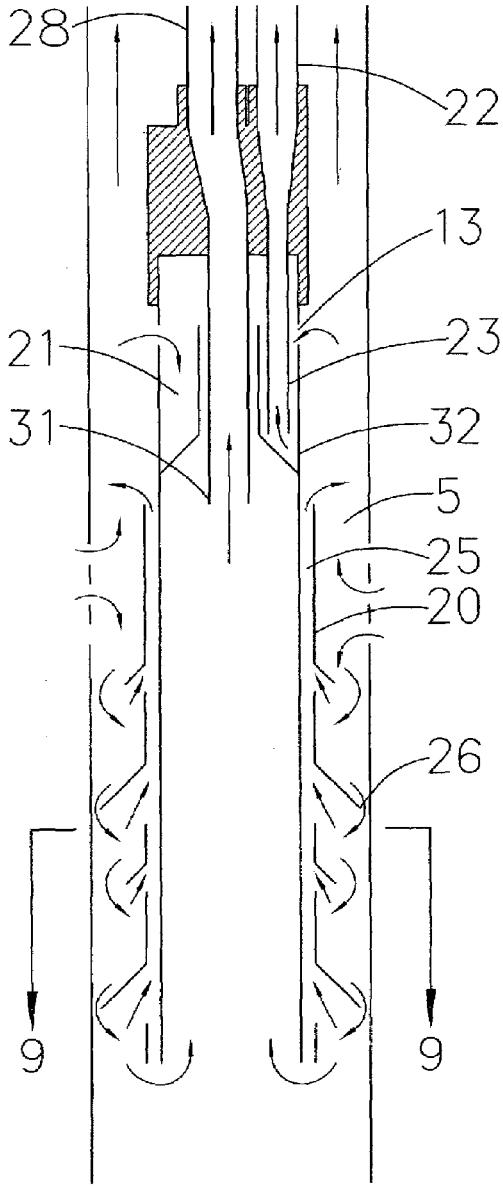
FIG. 7 is a sectional side view of an oil well complete with casing and dual tubing and illustrates a fourth embodiment of the invention having separation baffling and an oil sump.

FIG. 7 illustrates a fourth embodiment of the present invention. This embodiment includes a fluted spiral baffle 20, an oil sump 21, and a secondary production tubing 22. The oil sump 21 is in fluidic communication with the casing annulus 5 and the anchor annulus 9. This embodiment includes a variation in function where the oil column in the casing annulus 5 is allowed to spill over into the oil sump 21 inside an oil anchor 32 where it is then drawn up a secondary pump intake tube 23 and pumped to the surface via the secondary production tubing 22. If a conventional reciprocating rod pumping system is used for a primary production tubing 28, the difference in the depths of the base of a primary pump intake tube 31 and the oil anchor vent holes 13 should be engineered such that fluid fill up during the dead time of the down stroke will allow a volume of oil to enter the vent holes 13 (which volume is slightly less than the volume of oil produced by the formation during the dead time of the down stroke). The remainder of the oil will maintain the oil column in the casing annulus 5 and the primary production tubing 28 will produce water with a slight oil cut. If an alternate pumping system is utilized for the primary production tubing 28 (such as electric submersible), the necessary dead time could be controlled from the surface and adjusted as required to accommodate variable production rates.

Figure 8:
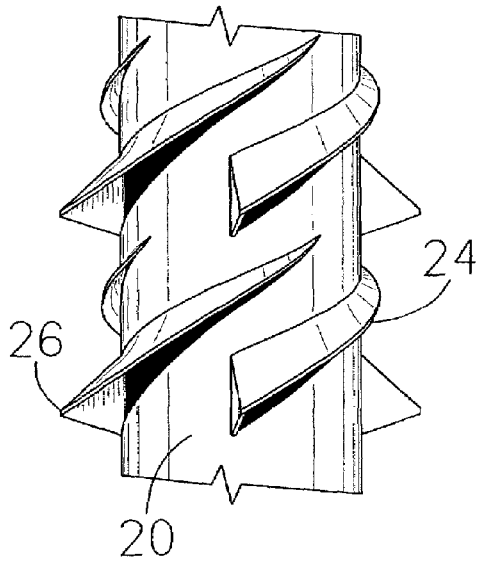
FIG. 8 is a side view of the fluted spiral baffle in FIG. 7.
Figure 9:
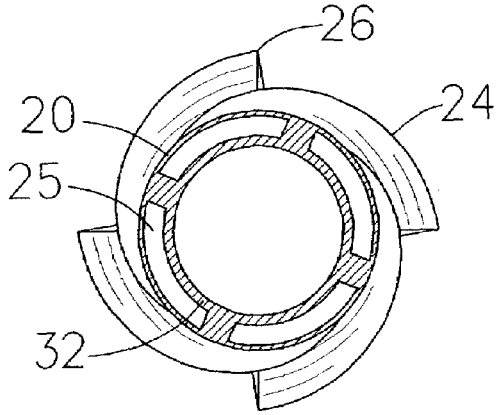
FIG. 9 is a plan view of the fluted spiral baffle along line 9—9 of FIG. 7.
Figure 10A:
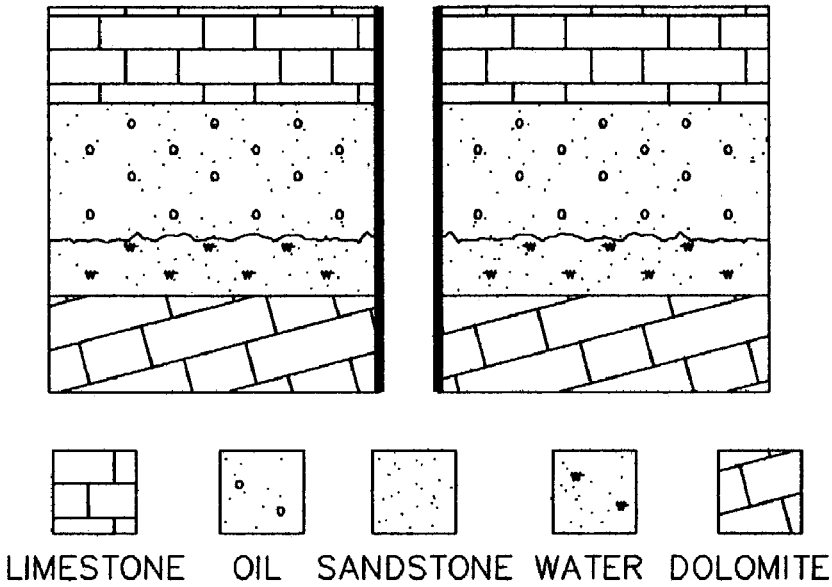
FIGS. 10(*a*) and 10(*b*) show an example of water coning.
Figure 10B:
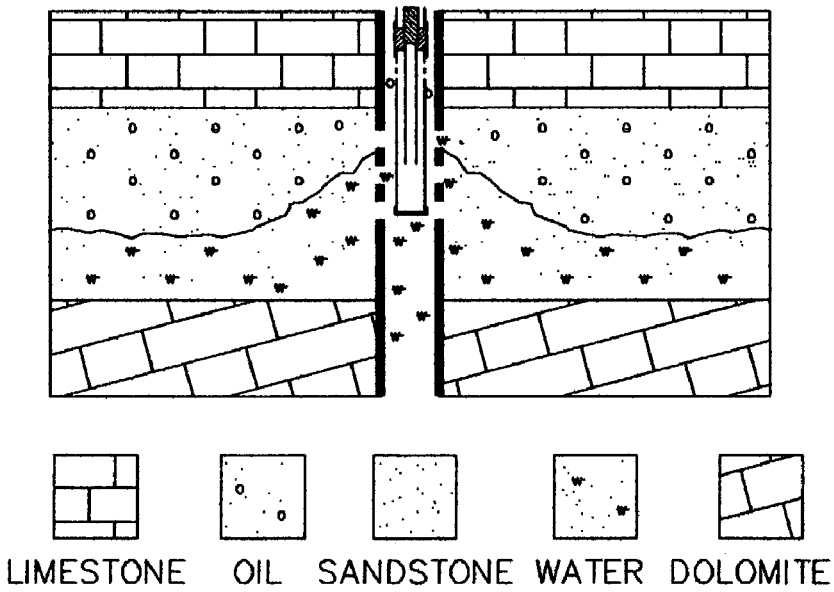

The fourth embodiment also includes a fluted spiral baffle 20 designed to separate additional oil and gas from the produced fluid. The baffle 20 encases the oil anchor 32 from its base to a level adjacent to the base of the primary pump intake tube 31. As produced fluid moves down the casing annulus 5, a spiraling current will develop as the fluid swirls over the edges 24 (shown in FIGS. 8 and 9) of the spiraling flutes. Slowing of the flow along the underside of the flutes will allow gas and oil to break from the water and move up an annulus 25 formed between the oil anchor 32 and the baffle 20 (shown in FIGS. 7 and 9), rejoining the oil column above the perforations 3. The tips 26 of the spiraling flutes may be rounded or may include, for example, an attached guard rail to prevent wellbore snags. The baffle 20 may be attached to any embodiment of the present invention for enhanced gas/oil/water separation. Any functional combination of the four illustrated embodiments as well as obvious variations are within the scope of the present invention.

What is claimed is:

1. An apparatus for the production of petroleum, comprising:

a pump intake tube comprising an opening, an oil anchor generally encircling the pump intake tube, the oil anchor comprising an open base, and vent holes in the oil anchor above the opening of the pump intake tube, a casing generally encircling the oil anchor, a casing annulus formed between the casing and the oil anchor, perforations in the casing that are below the opening of the pump intake tube and are above the open base of the oil anchor, wherein the casing annulus is open between the open base of the oil anchor and the opening of the pump intake tube to vent gas entering the perforations.

2. The apparatus according to claim 1, wherein the apparatus maintains an amount of petroleum on the perforations.

3. The apparatus according to claim 1, wherein a column of oil is formed in the casing annulus to submerse the perforations in oil.

4. The apparatus according to claim 1, further comprising an extension of additional tubing above the perforations, below the perforations, or both above and below the perforations.

5. The apparatus according to claim 4, wherein the extension above the perforations provides for adjusting a volume of a column of oil in the casing annulus.

6. The apparatus according to claim 4, wherein the extension below the perforations provides additional time for gas bubbles to expand, coalesce and separate from produced fluids in the casing annulus.

7. The apparatus according to claim 1, wherein scaling, plugging, fouling, or clogging of the perforations is reduced.

8. The apparatus according to claim 1, further comprising an enhancement of a chemical treatment program in the casing annulus during production to reduce scaling, plugging, fouling, or clogging of the perforations.

9. The apparatus of claim 1, wherein the apparatus reduces a coning effect of water or maintains an oil-wet rock in a producing formation in an oil-wet condition.

10. An apparatus for the production of petroleum, comprising:

a primary pump intake tube comprising an opening, an oil anchor generally encircling the primary pump intake tube, the oil anchor comprising a protective cap on the base of the oil anchor, the oil anchor further comprising intake holes, the oil anchor further comprising vent holes above the opening of the primary pump intake tube, a casing generally encircling the oil anchor, a casing annulus formed between the casing and the oil anchor and perforations in the casing that are below the opening of the primary pump intake tube and are above the intake holes of the oil anchor, wherein the casing annulus is open between the intake holes of the oil anchor and the opening of the pump intake tube to vent gas entering the perforations.

11. The apparatus according to claim 10, wherein the base of the oil anchor comprises a sediment shield to prevent intake plug-off in bottom sediment.

12. The apparatus according to claim 10, further comprising:

a spiral, fluted baffle encircling the oil anchor and forming a baffle annulus between the baffle and the oil anchor.

13. The apparatus according to claim 12, wherein the baffle annulus provides for separation of gas and petroleum from a produced fluid below the perforations and releases the gas and the petroleum into the casing annulus above the perforations.

14. The apparatus according to claim 12, further comprising:

an oil sump in fluidic connection with the casing annulus and an anchor annulus formed between the oil anchor and the primary pump intake tube, and the oil sump in fluidic communication with a secondary pump intake tube.

15. The apparatus according to claim 14, wherein the fluidic communication between the oil sump and the casing annulus is above the casing perforations.

16. The apparatus according to claim 15, wherein the fluidic communication between the oil sump and the anchor annulus is above the casing perforations and the opening of the primary pump intake tube.

17. A method of petroleum of production, comprising:

providing a pump intake tube comprising an opening, providing an oil anchor generally encircling the pump intake tube, the oil anchor comprising an open base, the oil anchor further comprising vent holes above the opening of the pump intake tube, providing a casing generally encircling the oil anchor, locating perforations in the casing below the opening of the pump intake tube and above the open base of the oil anchor, venting gas that enters the perforation through the casing annulus, wherein the casing annulus is open between the open base of the oil anchor and the opening of the pump intake tube, and pumping a produced fluid comprising petroleum and water.

18. The methods according to claim 17, further comprising maintaining a column of oil in a casing annulus to submerse the perforations in oil, wherein the casing annulus is between the casing and the oil anchor.

19. The method according to claim 17, further comprising reducing scaling, plugging, fouling, or clogging of the perforations.

20. The method according to claim 17, further comprising enhancing a chemical treatment program in the casing annulus during production to reduce scaling, plugging, fouling, or clogging of the perforations.

21. The method according to claim 17, further comprising minimizing water coning in a producing rock formation.

22. An apparatus for the production of petroleum, comprising:

a pump intake tube comprising an opening, an oil anchor generally encircling the pump intake tube, the oil anchor comprising an opening, the oil anchor comprising vent holes in the oil anchor above the opening of the pump intake tube, a casing generally encircling the oil anchor, a casing annulus formed between the casing and the oil anchor, perforations in the casing that are below the opening of the pump intake tube and are above the opening of the oil anchor, and the casing annulus is open between the opening of the oil anchor and the opening of the pump intake tube to vent gas entering the perforations.

* * * * *